US011213871B2

(12) United States Patent
Loehe

(10) Patent No.: US 11,213,871 B2
(45) Date of Patent: Jan. 4, 2022

(54) DECOUPLED ADJUSTMENT OF CONTOUR AND FLATNESS OF A METAL STRIP

(71) Applicant: Primetals Technologies Germany GmbH, Erlangen (DE)

(72) Inventor: Klaus Loehe, Fürth (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 0 days.

(21) Appl. No.: 17/276,609

(22) PCT Filed: Sep. 19, 2019

(86) PCT No.: PCT/EP2019/075161
§ 371 (c)(1),
(2) Date: Mar. 16, 2021

(87) PCT Pub. No.: WO2020/069875
PCT Pub. Date: Apr. 9, 2020

(65) Prior Publication Data

US 2021/0268561 A1 Sep. 2, 2021

(30) Foreign Application Priority Data

Oct. 3, 2018 (EP) ..... 18198437

(51) Int. Cl.
*B21B 37/28* (2006.01)
*B21B 38/02* (2006.01)

(52) U.S. Cl.
CPC ..... *B21B 37/28* (2013.01); *B21B 38/02* (2013.01); *B21B 2263/04* (2013.01)

(58) Field of Classification Search
CPC ..... B21B 37/28; B21B 37/005; B21B 37/16; B21B 37/165
See application file for complete search history.

(56) References Cited

U.S. PATENT DOCUMENTS

2015/0298186 A1* 10/2015 Zhang ..... B21B 1/26 72/240
2017/0259313 A1* 9/2017 Fairlie ..... B21B 37/74

FOREIGN PATENT DOCUMENTS

DE 3401894 A1 7/1985
DE 3823767 A1 1/1989
(Continued)

OTHER PUBLICATIONS

International Search Report and Written Opinion received in International Application No. PCT/EP2019/075161 dated Dec. 13, 2019, pp. 14.
(Continued)

*Primary Examiner* — Gregory D Swiatocha
*Assistant Examiner* — Bobby Yeonjin Kim
(74) *Attorney, Agent, or Firm* — Liang & Hennessey LLP; Brian Hennessey

(57) ABSTRACT

A control device of the rolling mill line controls actuators of a downstream and an upstream roll stand. The control device determines control variables for the actuators of the upstream roll stand while taking into consideration a flatness change to be carried out and additionally taking into consideration a contour change to be carried out and controls the actuators of the upstream roll stand accordingly. The control device determines control variables for the actuators of the downstream roll stand while taking into consideration the contour change to be performed but without taking into consideration the flatness change to be performed and controls the actuators of the downstream roll stand accordingly. The control device outputs the control variables to the actuators of the downstream roll stand with a delay of a transport time, relative to the corresponding control variables for the actuators of the upstream roll stand.

4 Claims, 5 Drawing Sheets

(56) References Cited

FOREIGN PATENT DOCUMENTS

| | | | |
|---|---|---|---|
| DE | 19851554 | A1 | 5/2000 |
| DE | 10324679 | A1 | 12/2004 |

OTHER PUBLICATIONS

European Search Report received in European Application No. 18198437.8 dated Feb. 25, 2019, pp. 7.

* cited by examiner

DECOUPLED ADJUSTMENT OF CONTOUR AND FLATNESS OF A METAL STRIP

CROSS-REFERENCE TO RELATED APPLICATIONS

The present application is a national phase application of PCT Application No. PCT/EP2019/075161, filed Sep. 19, 2019, entitled "DECOUPLED ADJUSTMENT OF CONTOUR AND FLATNESS OF A METAL STRIP", which claims the benefit of European Patent Application No. 18198437.8, filed Oct. 3, 2018, each of which is incorporated by reference in its entirety.

BACKGROUND OF THE INVENTION

1. Field of the Invention

The present invention relates to an operating method for a roll train having a plurality of roll stands, typically a multi-stand finishing roll train, through which a metal strip, e.g. a steel strip, passes one after the other sequentially.

2. Description of the Related Art

DE 34 01 894 A1 discloses various operating methods for a roll train having a plurality of roll stands, wherein a metal strip passes through the roll stands sequentially one after the other. A control device of the roll train controls both actuators of a downstream roll stand and actuators of an upstream roll stand of the roll train, said upstream roll stand being arranged upstream of the downstream roll stand. In one of these operating methods, the control device determines for each of the roll stands control variables (also referred to as manipulated variables) for the actuators of the respective roll stand while taking into consideration either a flatness change to be performed for the respective roll stand or a profile change to be performed for the respective roll stand. In another of these operating methods, the control device determines control variables for the actuators of the last roll stand of the roll train while taking into consideration a flatness change to be performed and additionally taking into consideration a profile change to be performed. For the other roll stands, the control device in this case determines control variables for the actuators of these roll stands while taking into consideration the profile change to be performed but not the flatness change to be performed. For the output of the control variables to the upstream roll stands of the roll train, the control device in this case takes into consideration transfer times to the subsequent stands.

SUMMARY OF THE INVENTION

The present invention starts from an operating method for a roll train having a plurality of roll stands, typically a multi-stand finishing roll train, through which a metal strip, e.g. a steel strip, passes one after the other sequentially.

The present invention furthermore starts from a control program for a control device for a roll train which has a plurality of roll stands, through which a metal strip passes one after the other sequentially, wherein the control program comprises machine code that can be executed by the control device, wherein the execution of the machine code by the control device has the effect that the control device controls the roll train in accordance with an operating method of this kind.

The present invention furthermore starts from a control device for a roll train which has a plurality of roll stands, through which a metal strip passes one after the other sequentially, wherein the control device is programmed with a control program of this kind, with the result that the control device controls the roll train in accordance with an operating method of this kind during the operation of the roll train.

The present invention furthermore starts from a roll train for rolling a metal strip, wherein the roll train has a plurality of roll stands, through which the metal strip passes one after the other sequentially, wherein the roll train has a control device that controls the roll train.

In rolling metal strips, there is, on the one hand, the desire that the rolled metal strip should have a defined contour, e.g. should be slightly cambered, with the result that it is somewhat thicker in the center of the strip than at the edges of the strip. On the other hand, there is the desire that the rolled metal strip should as far as possible be free of internal stresses, i.e. should be as flat as possible. For this reason, the usual practice in the prior art is to metrologically record and control both the profile (or more generally the contour) and the flatness at an appropriate measurement location after the last stand of a roll train.

In the prior art, flatness control takes effect on the roll stand arranged immediately upstream of the measurement location, i.e. the last roll stand of the roll train. It would be ideal if the contour control could also act on this roll stand. However, the contour and flatness cannot be set independently of one another on a single roll stand. This is because, in particular, both target variables are determined quite significantly by the shape of the rolling gap of the relevant roll stand. In the prior art, the contour control therefore usually acts on the upstream roll stands of the roll train, in particular the first roll stand of the roll train. This procedure is based on the consideration that the metal strip in the upstream roll stands is even thicker and therefore material cross flow is possible.

However, the prior art approach still does not lead to decoupled adjustment of contour and flatness. On the contrary, low-frequency vibrations occur. The frequency of the vibration is determined—in relation to the material flow—by the amount of material of the metal strip located between the roll stand furthest downstream, which is controlled by the contour control system, and the measurement location. Furthermore, correction of the contour can be carried out only very slowly since all the material which is located between the roll stand furthest downstream, which is controlled by the contour control system, and the measurement location can no longer be corrected in respect of its contour. Moreover, the flatness control system, which can operate with a considerably shorter dead time, repeatedly falsifies the measurement signal for the contour control system.

It is the object of the present invention to provide means by which the flatness and contour can be adjusted independently of one another in a multi-stand roll train.

The object is achieved by means of an operating method having the features described herein. Advantageous embodiments of the operating method form the subject matter of the dependent claims.

According to the invention, an operating method for a roll train having a plurality of roll stands, in which a metal strip passes through the roll stands one after the other sequentially is configured in such a way that a control device of the roll train controls both actuators of a downstream roll stand and actuators of an upstream roll stand arranged upstream of the downstream roll stand, that the control device determines control variables for the actuators of the upstream roll stand while taking into consideration a downstream flatness change to be performed and additionally taking into consideration a contour change to be performed and controls the actuators of the upstream roll stand accordingly, that the control device determines control variables for the actuators of the downstream roll stand while taking into consideration the contour change to be performed but without taking into consideration the downstream flatness change to be performed and controls the actuators of the downstream roll stand accordingly, that the control device outputs the control variables for the actuators of the downstream roll stand to the actuators of the downstream roll stand, with a delay of a downstream transfer time relative to outputting the corresponding control variables to the actuators of the upstream roll stand however, and that the downstream transfer time is the time that elapses between the rolling of the metal strip in the upstream roll stand and the rolling of the metal strip in the downstream roll stand.

The downstream roll stand is generally the last roll stand of the roll train. The upstream roll stand is generally the roll stand which is situated immediately ahead of the downstream roll stand.

The decoupled adjustment of flatness and contour is in most cases performed as part of corresponding closed-loop control operations. In this case, the operating method is configured in such a way that the control device receives a downstream actual flatness and a downstream actual contour which the metal strip has downstream of the downstream roll stand of the roll train, that the control device comprises a downstream flatness controller and a contour controller, that the control device determines the downstream flatness change to be performed from the downstream actual flatness and a downstream setpoint flatness by means of the downstream flatness controller, and that the control device determines the contour change to be performed from the downstream actual contour and a setpoint contour by means of the contour controller.

The flatness and contour are detected by means of corresponding measuring devices. Such measuring devices are known per se.

In addition to the downstream actual flatness, the control device can receive an upstream actual flatness that the metal strip has between the upstream roll stand and the downstream roll stand of the roll train. In this case, the operating method can be configured in such a way that the control device comprises an upstream flatness controller, that the control device determines an upstream flatness change to be performed from the upstream actual flatness and an upstream setpoint flatness by means of the upstream flatness controller, that the control device additionally also controls actuators of a further roll stand arranged upstream of the upstream roll stand, that the control device determines control variables for the actuators of the further roll stand while taking into consideration the downstream flatness change to be performed, the contour change to be performed and the upstream flatness change to be performed and controls the actuators of the further roll stand accordingly, that the control device outputs the control variables for the actuators of the upstream roll stand to the actuators of the upstream roll stand, with a delay of an upstream transfer time relative to the corresponding control variables for the actuators of the further roll stand however, and that the upstream transfer time is the time that elapses between the rolling of the metal strip in the further roll stand and the rolling of the metal strip in the upstream roll stand.

By means of this embodiment, it is also possible in addition to adjust the flatness on the input side of the downstream roll stand in a manner which is selective and independent of the flatness and contour on the outlet side of the downstream roll stand.

The procedure described last can, if necessary, also be extended in an analogous manner to other roll stands.

It is possible that the control device selects the roll stand relative to which the control of the roll stand following said roll stand is initially delayed by the transfer time that elapses between the rolling of the metal strip in the one and the other of these two roll stands, that the control device additionally also controls the actuators of at least one roll stand arranged upstream of the selected roll stand, and a setting of the actuators of the roll stand arranged upstream of the selected roll stand is thereby changed accordingly, that the control device determines control of the actuators of the roll stand arranged upstream of the selected roll stand while taking into consideration the control of the actuators of the selected roll stand, which, for its part, has been determined while taking into consideration a flatness change to be performed and a contour change to be performed, that the control device outputs the control variables for the actuators of the roll stand arranged upstream of the selected roll stand to the actuators of the roll stand arranged upstream of the selected roll stand without taking into consideration transfer times between roll stands.

This embodiment allows improved adjustment of the contour while simultaneously reducing changes in the flatness thereby caused ahead of the upstream or the further roll stand.

It is even better if, in determining the control of the actuators of the roll stand arranged upstream of the selected roll stand, the control device takes into consideration the control of the actuators of the selected roll stand to a lesser extent than would be the case if scaling in accordance with the relative thicknesses of the metal strip of the roll stands involved. It is thereby possible to ensure that any changes in flatness that are caused by the procedure according to the invention are distributed between a number of intermediate stand regions before the selected roll stand.

In a particularly preferred embodiment, it is envisaged that the control device determines control variables for the actuators of the upstream roll stand from the downstream flatness change to be performed and from the contour change to be performed, while taking into consideration the effectiveness of actuators of the upstream roll stand, and controls the actuators of the upstream roll stand in accordance with the control variables determined, that the control device comprises an identification device, that the control device supplies the identification device with the downstream flatness change to be performed and/or variables underlying the downstream flatness change to be performed, that the control device supplies the identification device with a resulting change in the setting of the upstream roll stand and/or with variables underlying the resulting change in the setting, that the identification device stores the variables with which it is supplied for a period of time which is at least as long as the sum of the downstream transfer time and an additional transfer time, that the additional transfer time is the time that elapses between the rolling of the metal strip in the downstream roll stand and the reaching of a measurement location at which the downstream actual flatness is recorded metrologically, that the identification device corrects the effectiveness of the actuators of the upstream roll stand with reference to the downstream flatness change to be performed at a respective later point in time, with reference to the downstream flatness change to be performed at a respective earlier point in time, and with reference to the resulting change in setting determined for the earlier point in time, and that the difference between the later point in time and the earlier point in time is equal to the sum of the downstream transfer time and the additional transfer time.

This makes it possible to adapt the control variables acting on the individual actuators of the upstream roll stand to the actual sensitivities, thus making it possible to eliminate control errors more and more effectively over the course of time.

The variables underlying the downstream flatness change to be performed are the downstream actual flatness and the downstream setpoint flatness or the difference between them. The variables underlying the resulting change in setting are the downstream flatness change to be performed and the contour change to be performed.

The control device preferably performs the operating method according to the invention in real time. There is therefore direct integration into the control of the roll train.

The object is furthermore achieved by means of a control program. According to the invention, the execution of the program code by the control device has the effect that the control device controls the roll train in accordance with an operating method according to the invention.

The object is furthermore achieved by means of a control device. According to the invention, the control device is programmed with a control program according to the invention, and therefore the control device controls the roll train in accordance with an operating method according to the invention during the operation of the roll train.

The object is furthermore achieved by means of a roll train. According to the invention, the control device is designed as a control device according to the invention.

BRIEF DESCRIPTION OF THE DRAWINGS

The above-described properties, features and advantages of this invention and the manner in which these are achieved will become more clearly and distinctly comprehensible in conjunction with the following description of the illustrative embodiments, which are explained in greater detail in combination with the drawings. Here, in schematic illustration.

DETAILED DESCRIPTION

Figure 1:
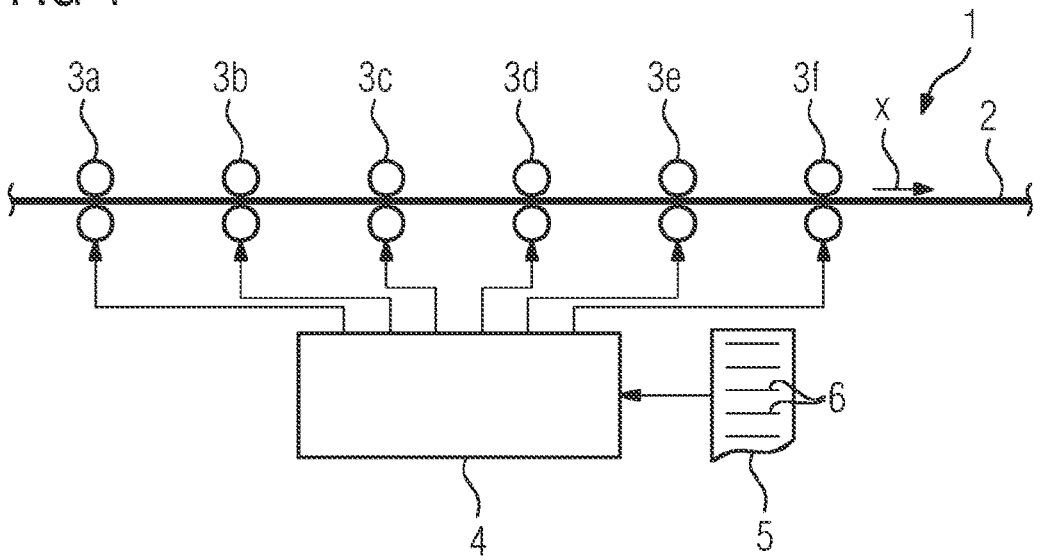
FIG. 1 shows a roll train for a metal strip.

According to FIG. 1, a metal strip 2 is rolled in a roll train 1. The metal strip 2 is generally hot-rolled in the roll train 1. In particular, the roll train 1 can be designed as a finishing train. In individual cases, however, cold rolling can be performed.

The roll train 1 has a plurality of roll stands 3, according to the illustration in FIG. 1 a total of six roll stands 3. In FIG. 1 and also in the other figures, a small letter (a to f) is added to the roll stands 3 to enable them to be distinguished from one another if required. Accordingly, the roll stands 3 are the first roll stand 3*a*, the second roll stand 3*b* etc., up to the sixth and last roll stand 3*f* of the roll train 1. However, the number of roll stands 3 could also be greater or smaller. The decisive factor is that there are at least two roll stands 3 and that the metal strip 2 passes through the roll stands 3 sequentially one after the other. An associated transfer direction is denoted by x in FIG. 1. In this context, the term "pass through sequentially one after the other" does not mean that the metal strip 2 is first of all fully rolled in one of the roll stands 3 and then fully rolled in the next of the roll stands 3. On the contrary, this term means that, although the metal strip 2 as a whole is rolled simultaneously in several roll stands 3, each individual segment of the metal strip 2 passes through the roll stands 3 sequentially one after the other. Moreover, it is only ever the working rolls of the roll stands 3 that are illustrated in FIG. 1 and also in the other figures. In general, the roll stands 3 have further rolls, in particular back-up rolls in the case of embodiment as four-high stands, or back-up rolls and intermediate rolls in the case of embodiment as six-high stands.

The roll train 1 is controlled by a control device 4. In general, control device 4 is designed as a software-programmable control device. The control device 4 is programmed by means of a control program 5. The control program 5 comprises machine code 6 that can be executed by the control device 4. In operation, the control device 4 executes the machine code 6. The execution of the machine code 6 by the control device 4 has the effect that the control device 4 controls the roll train 1 in accordance with an operating method which is explained in greater detail below. Here, the basic principle of the present invention is first of all explained in conjunction with FIG. 2, after which, likewise in conjunction with FIG. 2, a conventional embodiment and then, in conjunction with FIGS. 3 to 5, further embodiments are explained.

Figure 2:
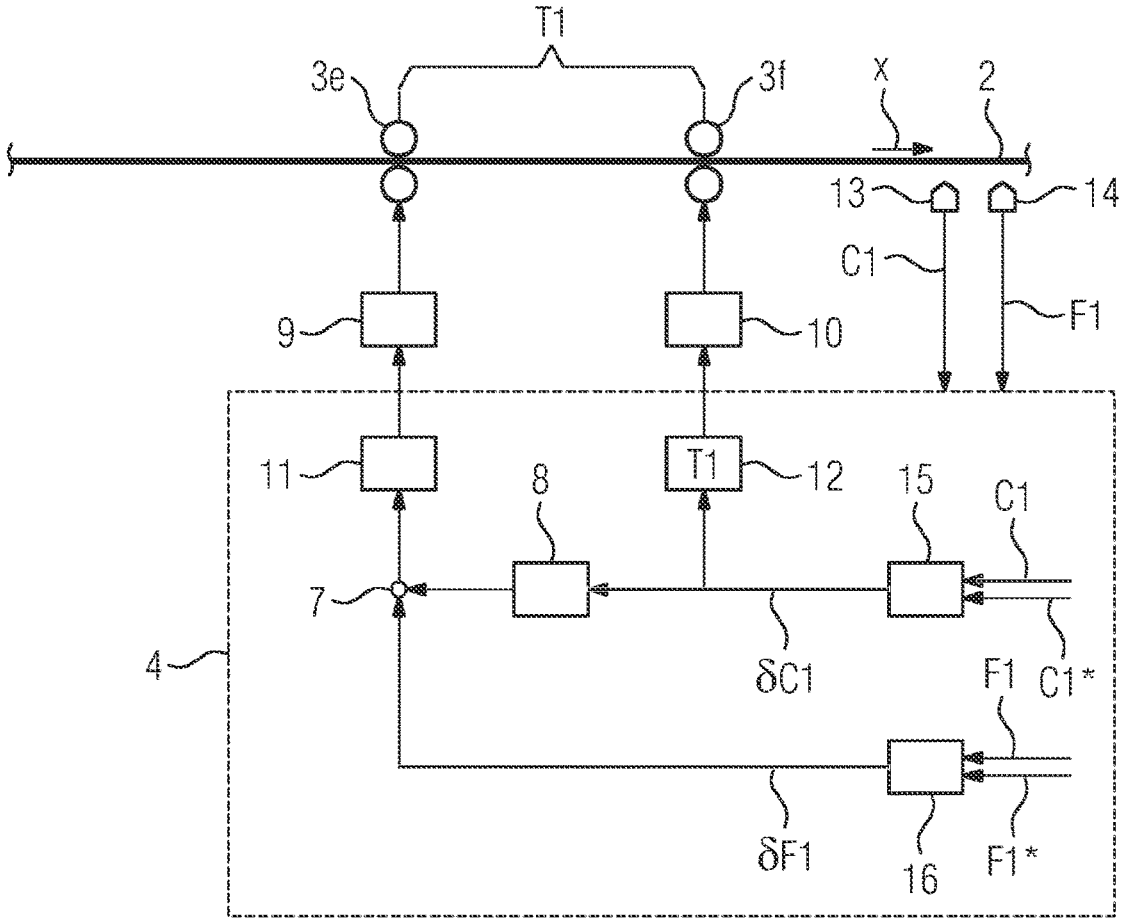
FIG. 2 shows a downstream and an upstream roll stand and associated components.

FIG. 2 shows an upstream roll stand and a downstream roll stand. Based on the two roll stands 3 illustrated in FIG. 2, the upstream roll stand is the roll stand 3 through which the metal strip 2 passes first. Once again based on the two roll stands 3 illustrated in FIG. 2, the downstream roll stand is accordingly the roll stand 3 through which the metal strip 2 passes last. In accordance with the illustration in FIG. 2, the downstream roll stand is generally the last roll stand 3*f* of the roll train 1, and the upstream roll stand is the penultimate roll stand 3*e* of the roll train 1. For this reason, the reference sign 3*f* is used below for the downstream roll stand, and the reference sign 3*e* is used for the upstream roll stand. However, the upstream and downstream roll stand do not have to be these two roll stands 3. Furthermore, the upstream and the downstream roll stand 3*e*, 3*f* generally immediately follow one another within the roll train 1.

According to FIG. 2, a flatness change δF1 is known to the control device 4. Further details of the determination of the flatness change δF1 are given below. The flatness change δF1 is referred to below as the downstream flatness change δF1 to enable it to be distinguished verbally from upstream flatness change βF2 introduced later. In accordance with the downstream flatness change δF1, the flatness of the metal strip 2 is to be changed downstream of the downstream roll stand 3*f* The flatness change δF1 is supplied to a node 7.

According to FIG. 2, a contour change δC1 is furthermore known to the control device 4. Further details of the determination of the contour change δC1 are also given below. The contour change δC1 is referred to below as the downstream contour change δC1 because, in accordance with the contour change δC1, the contour of the metal strip 2 is to be changed downstream of the downstream roll stand 3*f*. The control device 4 supplies the downstream contour change δC1 first of all to a first adaptation element 8. In the first adaptation element 8, the dynamic behavior of actuators 9 of the upstream roll stand 3*e* and of downstream actuators 10 of the downstream roll stand 3*f*, in particular the relationship between these two dynamic behaviors, is taken into consideration. The output signal of the first adaptation element 8 is supplied to the node 7.

In the node 7, the two values supplied to the node 7 are combined with one another by addition or subtraction. The output signal is supplied via a second adaptation element 11 to the actuators 9 of the upstream roll stand 3*e*. In the second adaptation element 11, consideration is given, in particular, to the relationship between the thickness of the metal strip 2 in the upstream and the downstream roll stand 3*e*, 3*f* and the thickness of the metal strip 2 downstream of the downstream roll stand 3*f*.

The control device 4 supplies the change in setting for the upstream roll stand 3*e* that now results to the actuators 9 of the upstream roll stand 3*e*. Thus, it controls the actuators 9 of the upstream roll stand 3*e* accordingly. By virtue of the corresponding control that results, a setting of the actuators 9 is changed in accordance with the resulting change in setting. As a result, the control device 4 thus determines the control variables for the actuators 9 of the upstream roll stand 3*e* while taking into consideration the downstream flatness change δF1 to be performed and additionally taking into consideration the downstream contour change δC1 to be performed.

The actuators 9 act on the rolling gap of the upstream roll stand 3*e*. The actuators 9 thereby influence both the flatness and the contour of the metal strip 2 passing out of the upstream roll stand 3*e*. For example, the actuators 9 can be an actuator for asymmetric wedge adjustment of the rolling gap, an actuator for roll bending, an actuator for roll twisting, an actuator for axial movement of rolls, actuators for location-dependent cooling or heating of rolls in the transverse direction of the metal strip 2, or actuators for location-dependent lubrication of rolls in the transverse direction of the metal strip 2. Other actuators are also possible. The only exception is the symmetrical adjustment of the spacing between the working rolls of the upstream roll stand 3*e*, i.e. the adjustment of the (mean) strip thickness, this adjustment being uniform across the width of the rolling gap.

In accordance with the illustration in FIG. 2, the control device 4 furthermore also controls the actuators 10 of the downstream roll stand 3*f*. A setting of the actuators 10 is thereby changed accordingly. The control device 4 determines the control variables for the actuators 10 of the downstream roll stand 3*f*, but while taking into consideration only the downstream contour change δC1 to be performed. The downstream flatness change δF1 is not taken into consideration.

Control of the actuators 10 is furthermore not performed directly, instantly and immediately but via a delay element 12. The delay element 12 delays the variables with which it is supplied by a transfer time T1, referred to below as the downstream transfer time. The downstream transfer time T1 is the time during which a certain segment of the metal strip 2 is conveyed from the upstream roll stand 3*e* to the downstream roll stand 3*f*. Thus, it is the time that elapses between the rolling of a certain segment of the metal strip 2 in the upstream roll stand 3*e* and the rolling of the same segment of the metal strip 2 in the downstream roll stand 3*f*. The transfer time T1 is not necessarily a constant but may be corrected dynamically at any time on the basis of tracking of the segments of the metal strip 2.

Thus, admittedly, the control device 4 obviously also outputs control variables to the downstream roll stand 3*f* at the point in time at which it outputs control variables to the upstream roll stand 3*e*. However, the control variables output at this point in time to the downstream roll stand 3*f* are based on control variables output to the upstream roll stand 3*e* which have already been output at an earlier point in time to the upstream roll stand 3*e*. The time difference is precisely the downstream transfer time T1.

The actuators 10 of the downstream roll stand 3*f* act on the rolling gap of the downstream roll stand 3*f*. The actuators 10 thereby influence both the flatness and the contour of the metal strip 2 passing out of the downstream roll stand 3*f*. The actuators 10 can be designed and can act in the same way as the actuators 9 of the upstream roll stand 3*e*.

Arranged downstream of the downstream roll stand 3*f* there is usually a measuring device 13, by means of which the contour C1 of the metal strip 2 downstream of the downstream roll stand 3*f* is recorded metrologically. The contour C1 is referred to below as the downstream actual contour. Arranged downstream of the downstream roll stand 3*f* there is furthermore a measuring device 14, by means of which the flatness F1 of the metal strip 2 downstream of the downstream roll stand 3*f* is recorded metrologically. The flatness F1 is referred to below as the downstream actual flatness. Corresponding measuring devices 13, 14 are a matter of common knowledge to those skilled in the art. The downstream actual contour C1 recorded and the downstream actual flatness F1 recorded are supplied to the control device 4. The control device 4 receives these variables C1, F1.

The control device 4 comprises a contour controller 15. The control device 4 supplies the contour controller 15 with the recorded downstream actual contour C1 and a setpoint contour C1*. By means of the contour controller 15, the control device 4 determines the downstream contour change δC1 to be performed from the downstream actual contour C1 and the setpoint contour C1*. The manner in which the contour controller 15 determines the downstream contour change δC1 to be performed can be specified according to requirements. In the simplest case, the contour controller 15 merely performs simple profile regulation, i.e. regulation to a (scalar) profile value. However, it is also possible for the contour controller 15 to perform a more complex type of regulation. In both cases, it is possible in principle for the contour controller 15 to be designed in the manner also known in the prior art. However, other embodiments are also possible.

The control device 4 furthermore comprises a downstream flatness controller 16. The control device 4 supplies the downstream flatness controller 16 with the recorded downstream actual flatness F1 and a setpoint flatness F1*. The setpoint flatness F1* is referred to below as the downstream setpoint flatness. By means of the flatness controller 16, the control device 4 determines the downstream flatness change δF1 to be performed from the downstream actual flatness F1 and the setpoint flatness F1*. It is possible in principle for the downstream flatness controller 16 to be designed in the manner also known in the prior art. However, other embodiments are also possible.

One possible embodiment of the present invention is explained below in conjunction with FIG. 3. This embodiment is based on the embodiment in FIG. 2. Only the additional elements will therefore be explained in greater detail below.

Figure 3:
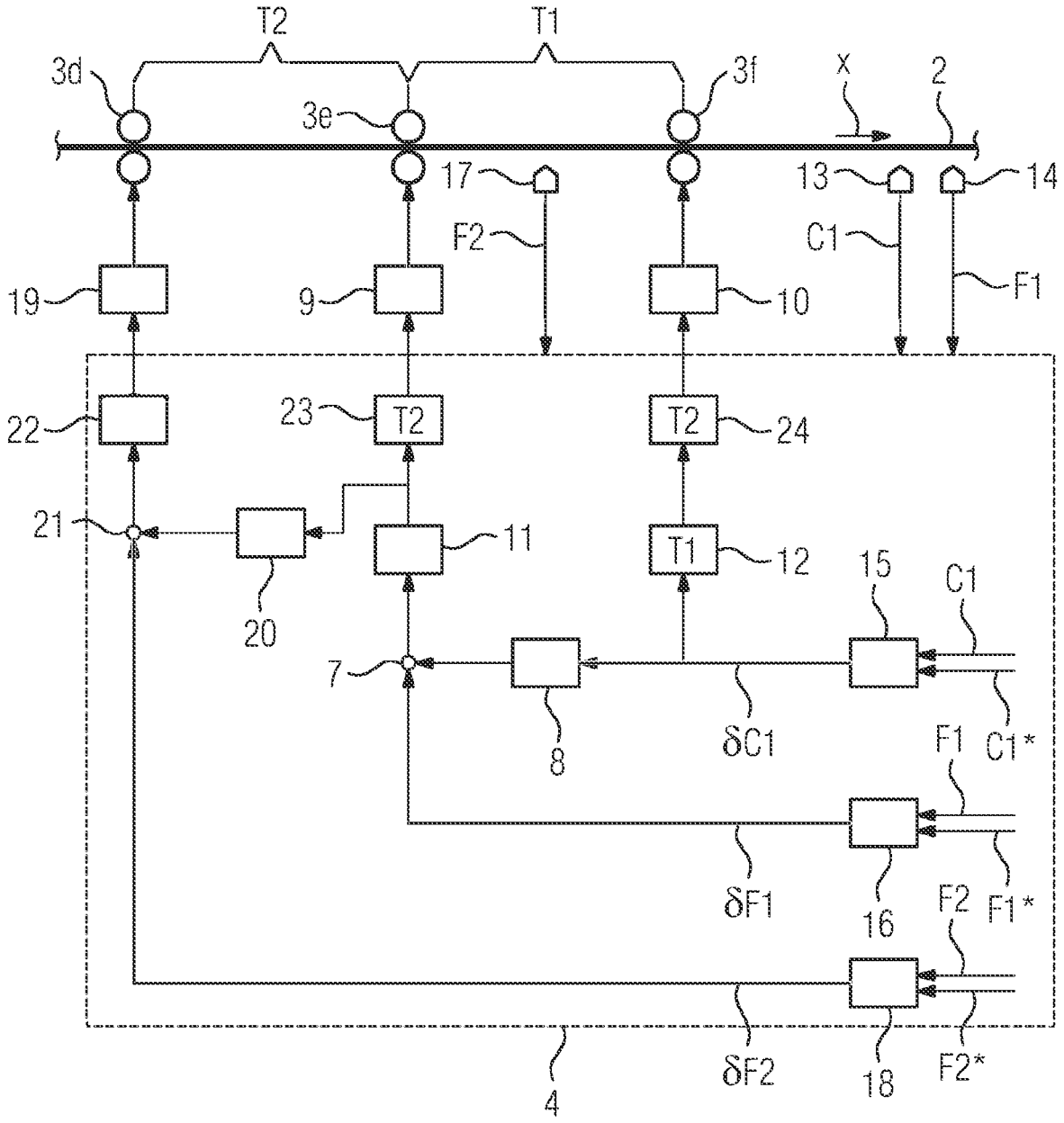
FIG. 3 shows a downstream, an upstream and a further roll stand and associated components.

In accordance with the illustration in FIG. 3, there is additionally a further measuring device 17. The further measuring device 17 is arranged between the upstream roll stand 3*e* and the downstream roll stand 3*f* The further measuring device 17 is used as a means to metrologically record the flatness F2 that the metal strip 2 has between the upstream roll stand 3*e* and the downstream roll stand 3*f*. To distinguish it from the downstream actual flatness F1, the flatness F2 is referred to below as the upstream actual flatness. The upstream actual flatness F2 recorded is likewise supplied to the control device 4. The control device 4 receives the upstream actual flatness F2.

The control device 4 furthermore comprises an upstream flatness controller 18. The upstream flatness controller 18 can be of a design similar to the downstream flatness controller 16. The control device 4 supplies the upstream flatness controller 18 with the recorded upstream actual flatness F2 and a setpoint flatness F2*. To distinguish it from the downstream setpoint flatness F1*, the setpoint flatness F2* is referred to below as the upstream setpoint flatness. By means of the upstream flatness controller 18, the control device 4 determines a flatness change βF2 to be performed, referred to below as the upstream flatness change, from the upstream actual flatness F2 and the upstream setpoint flatness F2*.

In the context of the embodiment shown in FIG. 3, the control device 4 furthermore additionally also controls actuators 19 of a further roll stand 3 arranged upstream of the upstream roll stand 3*e*. In general, this is the roll stand arranged immediately upstream of the upstream roll stand 3*e*. For this reason, the reference sign 3*d* is used below for the further roll stand.

To determine the resulting control for the actuators 19 of the further roll stand 3*d*, the control device 4 comprises a third adaptation element 20 and a further node 21. The control device 4 supplies the third adaptation element 20 with the output signal of the second adaptation element 11. As explained above, both the downstream flatness change δF1 to be performed and the downstream contour change δC1 to be performed are taken into consideration in this signal. In the third adaptation element 20, the dynamic behavior of the actuators 19 of the further roll stand 3*d* and of the actuators 9 of the upstream roll stand 3*e*, in particular the relationship between these two dynamic behaviors, can be taken into consideration, for example. This is indeed preferred. The output signal of the third adaptation element 20 is supplied to the further node 21.

The upstream flatness change βF2 is furthermore supplied to the further node 21. In the further node 21, the two values supplied to the further node 21 are combined with one another by addition or subtraction. The output signal of the further node 21 is supplied to the actuators 19 of the further roll stand 3*d* via a fourth adaptation element 22 likewise i comprised in the control device 4. In the fourth adaptation element 22, consideration is given, in particular, to the relationship between the thickness of the metal strip 2 between the further and the upstream roll stand 3*d*, 3*e* and the thickness of the metal strip 2 between the upstream and the downstream roll stand 3*e*, 3*f*. As a result, the control device 4 thus determines the control variables for the actuators 19 of the further roll stand 3*d* while taking into consideration both flatness changes δF1, βF2 to be performed and the downstream contour change δC1 to be performed.

The control device 4 supplies the change in setting for the further roll stand 3*d* that now results to the actuators 19 of the further roll stand 3*d*. Thus, it controls the actuators 19 of the further roll stand 3*d* accordingly. By virtue of the corresponding control that results, a setting of the actuators 19 is changed in accordance with the resulting change in setting.

The actuators 19 act on the rolling gap of the subsequent roll stand 3*e*. The actuators 19 thereby influence both the flatness and the contour of the metal strip 2 passing out of the further roll stand 3*d*. The above statements relating to the actuators 9 of the upstream roll stand 3*e* can be applied in analogous fashion.

Analogously to the delay between the upstream roll stand 3*e* and the downstream roll stand 3*f*, it is also necessary in the context of the present invention for the control of the actuators 9 of the upstream roll stand 3*e* to be delayed by a transfer time T2 relative to the control of the actuators 19 of the further roll stand 3*d*. The transfer time T2 is referred to below as the upstream transfer time. The upstream transfer time T2 is the time that elapses between the rolling of a certain segment of the metal strip 2 in the further roll stand 3*d* and the rolling of the same segment of the metal strip 2 in the upstream roll stand 3*e*. To implement the upstream transfer time T2, the control device 4 comprises a further delay element 23, which is arranged downstream of the second adaptation element 11. Via the further delay element 23, control of the actuators 9 of the upstream roll stand 3*e* is performed.

The relative delay between the control of the upstream roll stand 3*e* and the control of the downstream roll stand 3*f*, i.e. the delay by the downstream transfer time T1, is to be retained unchanged. This can be accomplished, for example, by adapting the delay time of the delay element 12 accordingly. For systematic reasons, a different procedure is illustrated in FIG. 3. In this procedure, the delay time of the delay element 12 has been retained unchanged, but there is an additional delay element 24, in which the signal supplied to the downstream roll stand 3*f* is delayed by the upstream transfer time T2 in addition to the delay by the downstream transfer time T1.

If required, it is also possible in principle for the procedure explained above to be extended even further to roll stands 3 situated toward the input side of the roll train 1, that is to say in the present case roll stands 3*c*, 3*b* and 3*a*.

Another possible embodiment of the present invention is explained below in conjunction with FIG. 4. This embodiment too is based on the embodiment in FIG. 2. Only the additional elements will therefore be explained in greater detail below.

Figure 4:
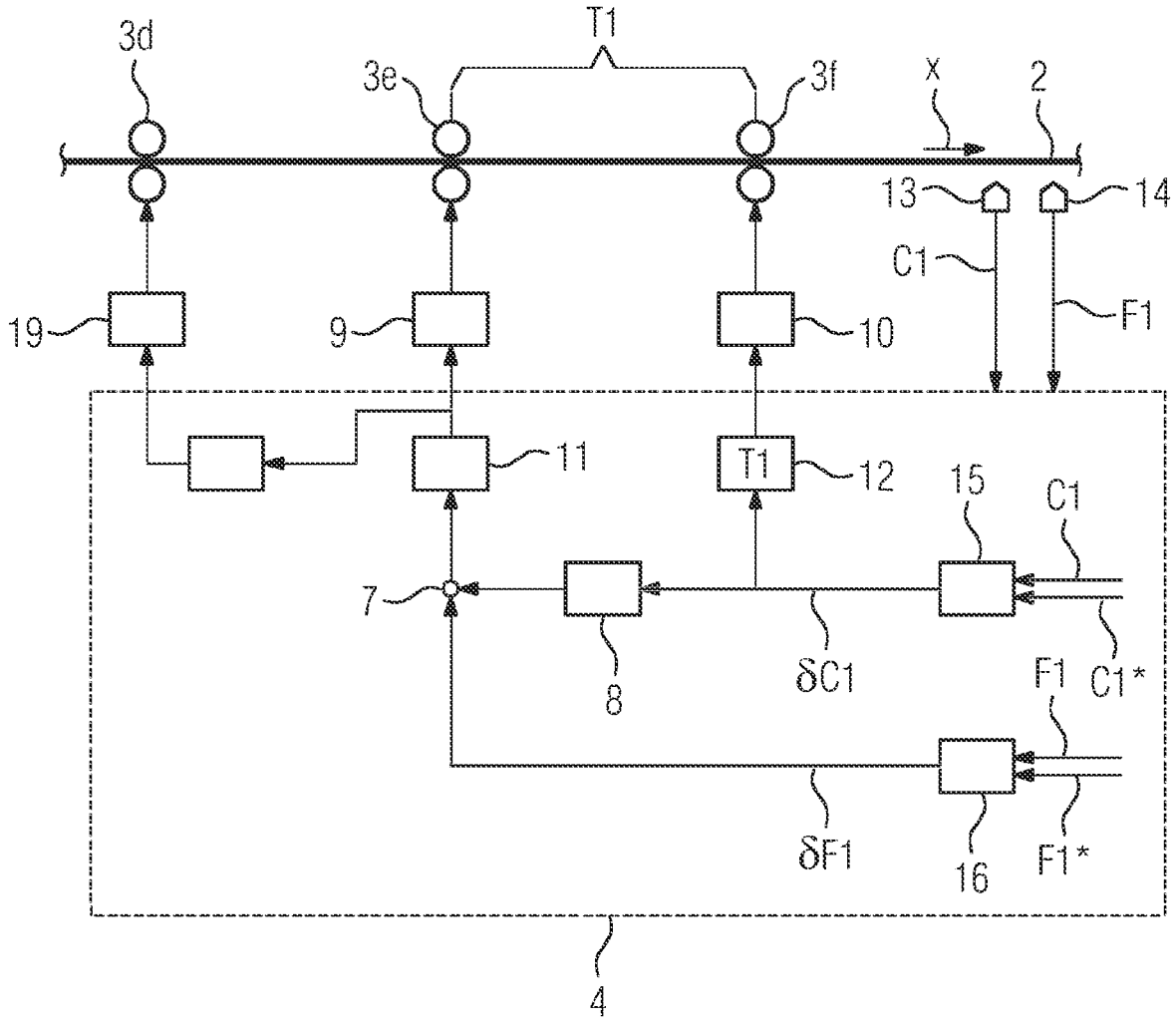
FIG. 4 shows a downstream and an upstream roll stand, and a roll stand arranged further upstream, and associated components.

In accordance with the illustration in FIG. 4, in the context of the operating method according to the invention the control device 4 additionally also controls the actuators 19 of the roll stand 3*d* that is arranged upstream of the upstream roll stand 3*e*. A setting of the actuators 19 is thereby changed accordingly. Also, in the embodiment illustrated in FIG. 4, the control device 4 controls the actuators 19 of the roll stand 3*d* arranged upstream of the upstream roll stand 3*e* while taking into consideration the control of the actuators 9 of the upstream roll stand 3*e*. However, in determining the control of the actuators 19 of the roll stand 3*d* arranged upstream, the control device 4 preferably takes this component into consideration only to a lesser extent than would be the case if scaling in accordance with the relative thicknesses of the metal strip 2 of the roll stands 3*d*, 3*e* involved. It is thereby possible, ahead of the upstream roll stand 3*e*, to achieve a gradual attenuation toward the inlet side of the roll train of the distortion of the metal strip 2 caused by the control of the upstream roll stand 3*e*. In the context of the embodiment shown in FIG. 4, the control device 4 outputs the control variables for these actuators 19 to the actuators 19 of the upstream roll stand 3*d* without taking into consideration transfer times T1, T2 between roll stands 3*d*, 3*e*, 3*f*.

In principle, the procedure in FIG. 4 can also be combined with the procedure in FIG. 3. In this case, roll stand 3*d* would replace roll stand 3*e*, and roll stand 3*c* would replace roll stand 3*d*. In each case, the feedforward control explained in conjunction with FIG. 4 takes place starting from the forwardmost roll stand 3*e*, 3*d*, whose transfer time T1, T2 to the next roll stand 3*f*, 3*e* is taken into consideration in the context of the control of the downstream roll stand 3*f*.

The procedure explained above can furthermore also be extended to a plurality of such roll stands 3, that is to say, for example, to roll stands 3*c*, 3*b* and 3*a* in addition to roll stand 3*d* in the embodiment shown in FIG. 4.

Another possible embodiment of the present invention is explained below in conjunction with FIG. 5. This embodiment too is based on the embodiment in FIG. 2. Only the additional elements of this embodiment will therefore be explained in greater detail below. This embodiment can furthermore also be combined, if required, with each of the embodiments shown in FIGS. 3 and 4.

Figure 5:
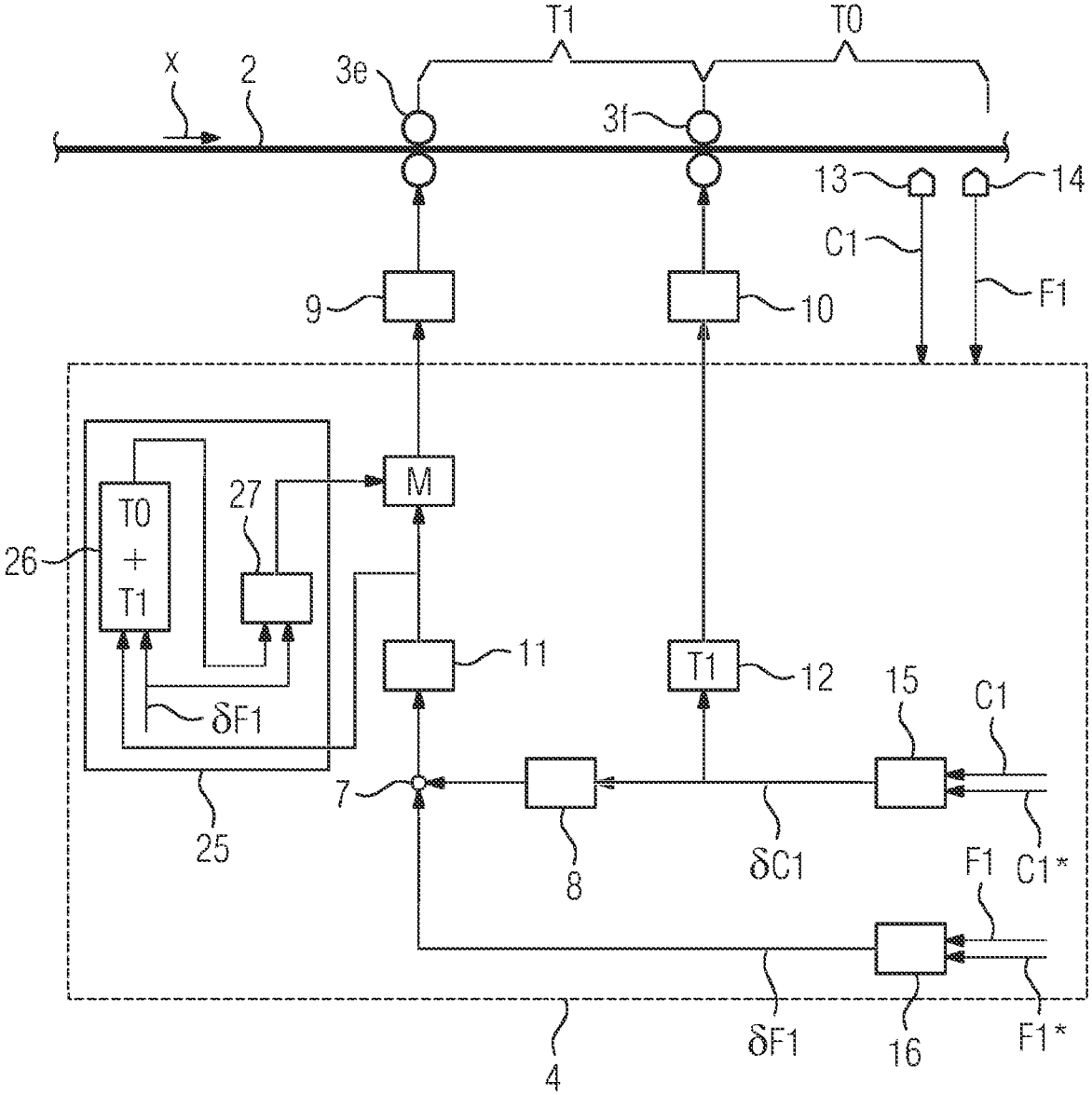
FIG. 5 shows a modification of FIG. 2.

According to FIG. 5—and also in FIGS. 2 to 4—the control device 4 determines the control variables for the actuators 9, 10 and 19 of the roll stands 3*e*, 3*f*, 3*d* involved while taking into consideration the effectiveness of the actuators 9, 10, 19 involved. Only the upstream roll stand 3*e* will be explained in detail below because only the upstream roll stand 3*e* is significant in the context of the embodiment in FIG. 5.

The effectiveness of the actuators 9 can be brought together in an effectiveness matrix M in accordance with the illustration in FIG. 5, for example, wherein the effectiveness matrix M is supplied with the change in the rolling gap contour that is to be set—that is to say here the rolling gap contour of the upstream roll stand 3*e*—and the associated control variables for the individual actuators 9 of the upstream roll stand 3*e* are determined by means of the effectiveness matrix M. On the one hand, these control variables are determined from the downstream flatness change δF1 to be performed and the downstream contour change δC1 to be performed because the rolling gap contour to be set depends on precisely these variablesδF1, δC1. On the other hand, they are determined from the effectiveness matrix M and hence while taking into consideration the effectiveness. Of course, the actuators 9 are controlled by the control device 4 in accordance with the control variables determined.

According to FIG. 5, the control device 4 comprises an identification device 25. On the one hand, the control device 4 supplies the identification device 25 with the downstream flatness change δF1 to be performed. Alternatively, the identification device 25 can also be supplied with variables underlying the downstream flatness change δF1 to be performed, in particular the downstream actual flatness F1 and the downstream setpoint flatness F1* or the difference thereof. The control device 4 furthermore supplies the identification device 25 with the resulting change in the setting of the upstream roll stand 3*e*, i.e. the output signal of the second adaptation element 11. Alternatively, the identification device 25 can also be supplied with variables underlying the resulting change in the setting of the upstream roll stand 3*e*, in particular the downstream flatness change δF1 to be performed and the downstream contour change δC1 to be performed.

The identification device 25 has a buffer memory 26. The buffer memory 26 can be designed as a circulating memory or as a shift register. In the buffer memory 26, the identification device 25 stores the variables supplied to it for a period of time. This period of time is at least as long as the sum of the downstream transfer time Ti and an additional transfer time T0. In this case, the additional transfer time T0 is the time that elapses between the rolling of a certain segment of the metal strip 2 in the downstream roll stand 3*f* and the reaching of the measurement location at which the downstream actual flatness F1 is recorded metrologically.

The identification device 25 furthermore has a determination device 27. In the determination device 27, the identification device 25 processes variables that are related to the same segment of the metal strip 2. On the one hand, these are the downstream flatness change δF1 to be performed at a respective earlier point in time and the resulting change in the setting of the upstream roll stand 3*e* determined for this. However, this is furthermore also the downstream flatness change 6F 1 to be performed at a later point in time. In this case, the difference between the later point in time and the earlier point in time is equal to the sum of the downstream transfer time T1 and the additional transfer time T0. The downstream flatness change δF1 to be performed at the later point in time thus contains information on the extent to which the correction performed at the earlier point in time has in fact led, through the resulting change in setting, to the downstream flatness change δF1 determined for the earlier point in time. Using this determination, the identification device 25 can therefore correct the effectiveness of the actuators 9 of the upstream roll stand 3*e*.

The core elements of the present invention are described once again briefly below in conjunction with FIG. 6.

Figure 6:
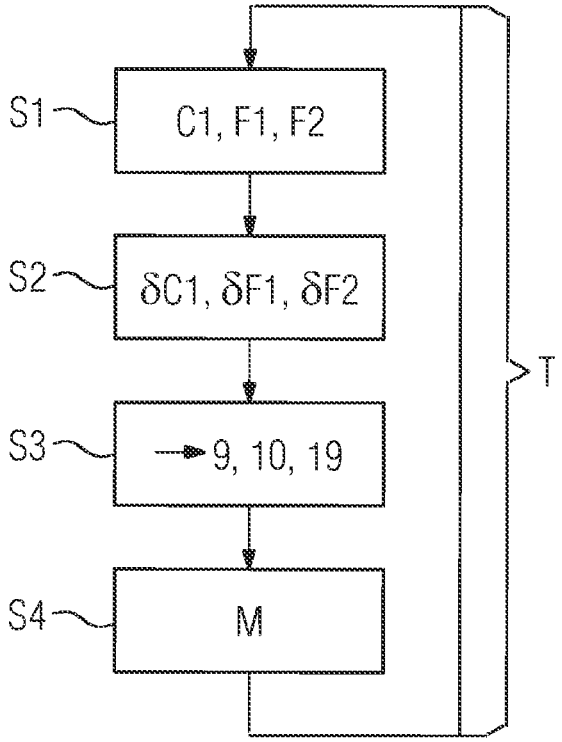
FIG. 6 shows a flow diagram.

According to FIG. 6, the control device 4 receives measured values at least for the downstream actual flatness F1 and the downstream actual contour C1 in a step S1. The control device 4 may also receive further measured values in step S1, e.g. the upstream actual flatness F2. In a step S2, the control device 4 determines the downstream flatness change δF1 and the contour change δC1. The control device 4 may also determine further flatness changes in step S2, e.g. the upstream flatness βF2. In a step S3, the control device 4 controls the actuators of the roll stands 3. In this case, the control device 4 controls at least the actuators 9, 10 of the upstream and of the downstream roll stand 3*e*, 3*f* in the manner according to the invention. In step S3, the control device may also control the actuators 19 of further roll stands 3*d* in the manner according to the invention. The control of the actuators 9 and 10 and optionally also 19 takes place while taking into consideration the relevant transfer times T1, T2. In an optional step S4, the control device 4 can correct the effectiveness of the actuators 9 of the upstream roll stand 3*e* via the identification device 25.

In accordance with the illustration in FIG. 6, the control device 4 carries out steps S1 to S4 iteratively. A cycle time T for one-time execution of steps S1 to S4 can be in the region of a few milliseconds. In this case, the control device 4 carries out the operating method according to the invention in real time. This is a matter of "level-1 automation". Alternatively, the cycle time may also have higher values (up to a few seconds). In this case, the control device 4 can alternatively carry out the operating method according to the invention in the context of level-1 automation or in the context of level-2 automation.

The present invention has many advantages. In particular, the contour C1 and the flatness F1 on the outlet side of the downstream roll stand 3*f* can be adjusted and controlled independently of one another. Owing to the decoupled control, the conception and design of the contour controller 15 and of the flatness controller 16 are furthermore simplified. Moreover, the fact that there is no longer any need to take account of mutual coupling increases the degrees of freedom in the design of the controllers. It is a simple matter to retrospectively modify the programming of a prior-art control device in such a way that the control device then acts in accordance with the invention. It is not necessary to replace the control device as such, i.e. to replace the hardware.

Although the invention has been illustrated and described more specifically in detail by means of the preferred illustrative embodiment, the invention is not restricted by the examples disclosed, and other variants can be derived therefrom by a person skilled in the art without exceeding the scope of protection of the invention.

LIST OF REFERENCE SIGNS

1 Roll train
2 Metal strip
3 Roll stands
4 Control device
5 Control program
6 Machine code
7, 21 Nodes
8, 11, 20, 22 Adaptation elements
9, 10, 19 Actuators
12, 23, 24 Delay elements
13, 14, 17 Measuring devices
15 Contour controller
16, 18 Flatness controller
25 Identification device
26 Buffer memory
27 Determination device
C1, C1* Contours
F1, F1* Flatnesses
F2, F2* Flatnesses
δC1 Contour change
δF1, βF2 Flatness changes
M Effectiveness matrix
S1 to S4 Steps
T Cycle time
T0, T1, T2 Transfer times
x Transfer direction

The invention claimed is:

1. An operating method for a roll train having a plurality of roll stands, through which a metal strip passes one after the other sequentially, comprising:

determining, by a control device of the roll train, first control variables for first actuators of an upstream roll stand of the plurality of roll stands, while taking into consideration a downstream flatness change to be performed and additionally taking into consideration a downstream contour change to be performed;

determining, by the control device, second control variables for second actuators of a downstream roll stand of the plurality of roll stands while taking into consideration the downstream contour change to be performed, the upstream roll stand being arranged upstream of the downstream roll stand;

controlling, by the control device, the first actuators based on the first control variables and the second actuators based on the second control variables, the control device outputting the second control variables to the second actuators with a delay of a downstream transfer time relative to the outputting of the first control variables to the first actuators, the downstream transfer time being a time that elapses between rolling of the metal strip in the upstream roll stand and rolling of the metal strip in the downstream roll stand;

selecting, by the control device, the upstream roll stand and the downstream roll stand from the plurality of roll stands;

determining, by the control device, further control variables for further actuators of a further roll stand of the plurality of roll stands while taking into consideration the first control variables; and controlling, by the control device, the further actuators of the further roll stand based on the further control variables, the control device outputting the further control variables to the further actuators without taking into consideration the downstream transfer time and an upstream transfer time, the upstream transfer time being a further time that elapses between rolling of the metal strip in the further roll stand and rolling of the metal strip in the upstream roll stand.

2. The operating method as claimed in claim 1, further comprising:

receiving, by the control device, a downstream actual flatness and a downstream actual contour which the metal strip has downstream of the downstream roll stand, the control device comprising a downstream flatness controller and a contour controller;

determining, by the control device, the downstream flatness change to be performed from the downstream actual flatness and a downstream setpoint flatness via the downstream flatness controller; and determining, by the control device, the downstream contour change to be performed from the downstream actual contour and a setpoint contour via the contour controller.

3. The operating method as claimed in claim 2, further comprising:

receiving, by the control device, an upstream actual flatness which the metal strip has between the upstream roll stand and the downstream roll stand, the control device comprising an upstream flatness controller;

determining, by the control device, an upstream flatness change to be performed from the upstream actual flatness and an upstream setpoint flatness via the upstream flatness controller;

further controlling, by the control device, further actuators of a further roll stand of the plurality of roll stands arranged upstream of the upstream roll stand; and determining, by the control device, further control variables for the further actuators of the further roll stand while taking into consideration the downstream flatness change to be performed, the downstream contour change to be performed, and the upstream flatness change to be performed and controlling the further actuators of the further roll stand accordingly;

wherein the first control variables are output by the control device to the first actuators of the upstream roll stand with a delay of an upstream transfer time relative to an output of the further control variables to the further actuators; and wherein the upstream transfer time is a further time that elapses between rolling of the metal strip in the further roll stand and rolling of the metal strip in the upstream roll stand.

4. The operating method as claimed in claim 1, wherein the control device carries out the operating method in real time.

* * * * *